US010866043B2

(12) United States Patent
Dechant

(10) Patent No.: US 10,866,043 B2
(45) Date of Patent: Dec. 15, 2020

(54) FIREARM WITH A DEVICE FOR DISASSEMBLY

(71) Applicant: Glock Technology GmbH, Deutsch Wagram (AT)

(72) Inventor: Friedrich Dechant, Hollabrunn (AT)

(73) Assignee: GLOCK TECHNOLOGY GMBH

( * ) Notice: Subject to any disclaimer, the term of this patent is extended or adjusted under 35 U.S.C. 154(b) by 0 days.

(21) Appl. No.: 16/413,010

(22) Filed: May 15, 2019

(65) Prior Publication Data

US 2019/0353438 A1 Nov. 21, 2019

(30) Foreign Application Priority Data

May 15, 2018 (EP) ..... 18172419
Jan. 17, 2019 (AT) ..... A 50036/2019

(51) Int. Cl.

| | |
|---|---|
| ***F41A 11/00*** | (2006.01) |
| ***F41A 17/36*** | (2006.01) |
| ***F41A 3/66*** | (2006.01) |
| ***F41A 19/30*** | (2006.01) |
| ***F41C 3/00*** | (2006.01) |

(52) U.S. Cl.
CPC ..... *F41A 3/66* (2013.01); *F41A 19/30* (2013.01); *F41C 3/00* (2013.01)

(58) Field of Classification Search
CPC .... F41A 3/66; F41A 3/68; F41A 11/00; F41A 17/30; F41A 17/32; F41A 17/34; F41A 17/36; F41A 17/42
See application file for complete search history.

(56) References Cited

U.S. PATENT DOCUMENTS

| | | | | | |
|---|---|---|---|---|---|
| 2,296,998 | A * | 9/1942 | Koehler | F41A 17/36 | 89/150 |
| 3,109,345 | A * | 11/1963 | Norman | F41A 3/44 | 89/144 |
| 4,203,348 | A * | 5/1980 | Sokolovsky | F41A 17/38 | 42/70.04 |
| 4,539,889 | A * | 9/1985 | Glock | F41A 5/04 | 89/147 |
| 4,627,184 | A * | 12/1986 | Ruger | F41A 15/16 | 42/25 |
| 4,825,744 | A | 5/1989 | Glock | | |
| 4,893,546 | A | 1/1990 | Glock | | |
| 5,267,406 | A * | 12/1993 | Ruger | F41A 15/14 | 42/25 |

(Continued)

FOREIGN PATENT DOCUMENTS

GB 151196 A 9/1920

*Primary Examiner* — Derrick R Morgan
(74) *Attorney, Agent, or Firm* — Raven Patents, LLC

(57) ABSTRACT

A firearm, especially a pistol, having a receiver and a guide rail for a slide that has a barrel, a retaining spring, and a slide stop device, the firearm further including a disassembling lever that is rotatable in the receiver, configured so that when the lever is in one end position:

a) an abutment of the slide abuts against the lever and cannot be moved further forward,
b) a fully inserted magazine is in contact with the lever and prevents any rotation, and
c) an upper surface of the lever lies opposite an edge of the slide.

When the magazine is withdrawn and the slide is stopped by the slide stop device, the lever can be rotated to allow the forward movement of the receiver.

4 Claims, 3 Drawing Sheets

(56) References Cited

U.S. PATENT DOCUMENTS 5,388,362 A * 2/1995 Melcher ..... F41A 17/36 42/70.02
6,266,909 B1 * 7/2001 Fuchs ..... F41A 19/31 42/70.05
6,865,979 B1 * 3/2005 Vaid ..... F41A 17/72 42/90
7,140,141 B2 * 11/2006 Vaid ..... F41A 11/00 42/108
7,360,331 B2 * 4/2008 McGarry ..... F41A 17/36 42/70.02
7,810,268 B1 * 10/2010 McGarry ..... F41A 11/00 42/69.01
8,495,832 B2 * 7/2013 Vukovic ..... F41A 17/36 42/70.02
8,528,243 B1 9/2013 Glock
8,590,200 B2 * 11/2013 Domian ..... F41A 17/36 42/70.01
8,935,872 B2 * 1/2015 Zukowski ..... F41A 17/56 42/70.02
8,950,100 B2 * 2/2015 Nebeker ..... F41A 3/64 42/108
9,891,014 B2 * 2/2018 Dechant ..... F41A 11/00
2003/0061753 A1 4/2003 Glock
2004/0111945 A1 6/2004 Glock
2005/0115130 A1 6/2005 Glock
2005/0229461 A1 * 10/2005 McGarry ..... F41A 17/02 42/70.08
2005/0246933 A1 * 11/2005 McGarry ..... F41A 17/36 42/70.02
2011/0126441 A1 * 6/2011 Vukovic ..... F41A 17/36 42/70.02
2011/0162248 A1 * 7/2011 Trpcic ..... F41A 17/56 42/108
2011/0167706 A1 7/2011 Glock
2012/0174453 A1 * 7/2012 Kallio ..... F41A 17/46 42/70.02
2013/0133237 A1 * 5/2013 Domian ..... F41A 17/36 42/70.02
2013/0239451 A1 9/2013 Glock
2014/0215880 A1 * 8/2014 Zukowski ..... F41A 17/36 42/70.02
2015/0192378 A1 7/2015 Hirschheiter
2015/0211822 A1 7/2015 Hirschheiter
2016/0069627 A1 * 3/2016 Cobb ..... F41A 9/65 42/70.02
2016/0109202 A1 * 4/2016 Weilharter ..... F41A 17/36 42/18
2016/0146559 A1 * 5/2016 Bantle ..... F41A 17/34 42/16
2017/0198993 A1 7/2017 Dechant
2017/0227313 A1 8/2017 Dechant

* cited by examiner

FIREARM WITH A DEVICE FOR DISASSEMBLY

The invention relates to a firearm, in particular a pistol, having a device for disassembly, corresponding to the introductory part of claim 1 and to GB 151 196.

BACKGROUND

This printed specification dating from 1920 discloses a pistol in which, when the magazine is fully inserted, it urges a spring-loaded cam into a position in which it is not possible to disassemble the firearm. If the magazine is withdrawn from the body by at least a certain amount, the cam is rotated under the action of its spring such that it permits the slide to be removed. Here, rotation of the cam also has the effect that the parts of the trigger mechanism that are in the receiver, often called frame, disengage from the parts in the slide, the firing pin mechanism—something which is likewise necessary for disassembly. This becomes dangerous if there is still a round in the barrel and, when the magazine is withdrawn, the uncoupled firing pin mechanism fires a shot as a result of a knock to the firearm or similar.

SUMMARY

Pistols are conventionally disassembled in that a movable barrier, which limits the forward movement of the slide—synonymously called a breech block—under the action of the retaining spring, is moved out of the path of the slide. Once this is done, the slide may in principle be removed forwards. However, the term "in principle" here also covers the fact that the trigger mechanism that is in the receiver of the pistol must be disengaged from the part in the slide, which is called the firing pin mechanism (synonymously also the hammer mechanism) as a whole, in order not to obstruct removal. A vast range of measures are available for this, depending on the conditions imposed by the construction.

Further conditions that need to be observed and are implicit in the term "in principle" are the conditions specified by the buyer or user, which may be of widely different types, and require for example that disassembly shall only be possible if there is no magazine in the body, and which may furthermore and independently thereof require that disassembly shall only be possible if the slide is held firmly in its rear position by a slide stop device, often called slide stop lever, and so on.

Since these requirements are imposed entirely erratically, without any technical or other necessity, and result in numerous special forms of firearms having to be derived from a basic form, there is a need to provide a device of this kind that cumulatively fulfils all requirements of this kind.

It is the object of the invention to provide a firearm, in particular a pistol, having a disassembly device of this kind.

The present disclosure is directed to a firearm having the features listed in the characterising clause of claim 1. In other words, in a firearm having a slide stop device, the holding device for the slide (breech block) is mounted in the receiver as a rotary part and takes a form such that neither rotation of the inserted magazine nor of the mounted slide is permitted, independently of one another, the latter with the proviso that, in its stopped position, the slide does not hinder rotation.

Thus, if in this position the magazine is withdrawn or has already been withdrawn previously, it is possible to rotate the holding part such that it no longer prevents forward movement of the slide. The separation of the trigger mechanism and the firing pin mechanism, which is likewise necessary, may be performed independently thereof, according to the design and basic construction of the pistol, and in different ways, for example by lowering the trigger mechanism or axially clearing the firing pin mechanism; there are examples of both variants in the prior art that those skilled in the art who have knowledge of the invention can readily adapt to the respectively applying case, if indeed an adaptation of this kind is at all necessary and feasible under the circumstances.

Even though the text below explains the invention in terms of a pistol, and pistols are the most frequent area of application, use with other firearms is nonetheless entirely possible in an advantageous manner.

BRIEF DESCRIPTION OF THE DRAWINGS

The invention will be explained in more detail below with reference to the drawing, in which.

DETAILED DESCRIPTION

Figure 1:
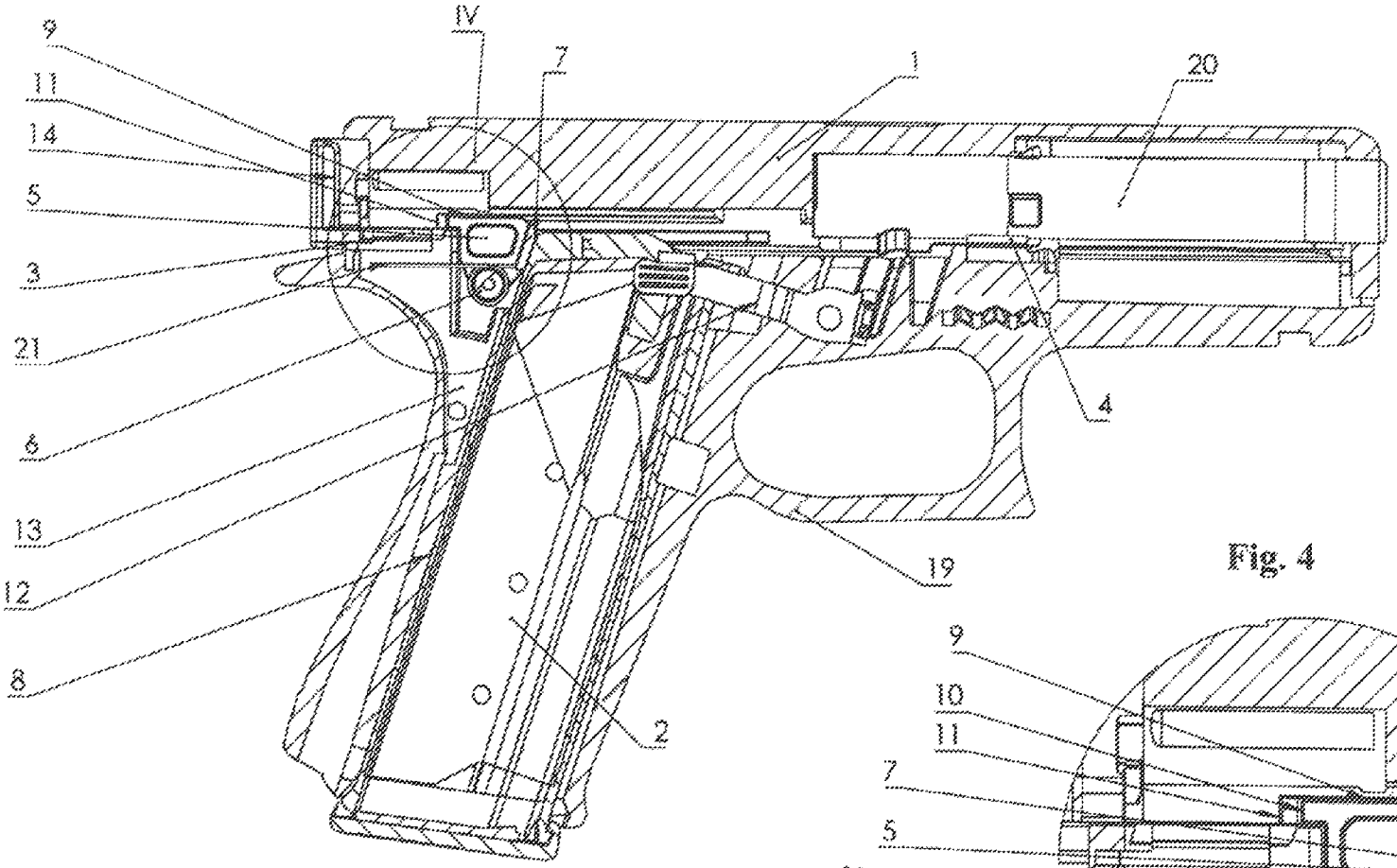
FIG. 1 shows a firearm according to the invention, ready for firing.

FIG. 1 illustrates a pistol constructed according to the invention, ready to fire, with a slide 1 and a magazine 2. The receiver 19 has a rear guide rail 3 and a front guide rail 4 for the slide 1, which has cooperating counterparts which are not shown in detail. A disassembling lever 5, which is mounted to rotate in the receiver 19, and a slide stop device having the form of a slide stop lever 12 are clearly visible, as well as a barrel 20.

Figure 4:
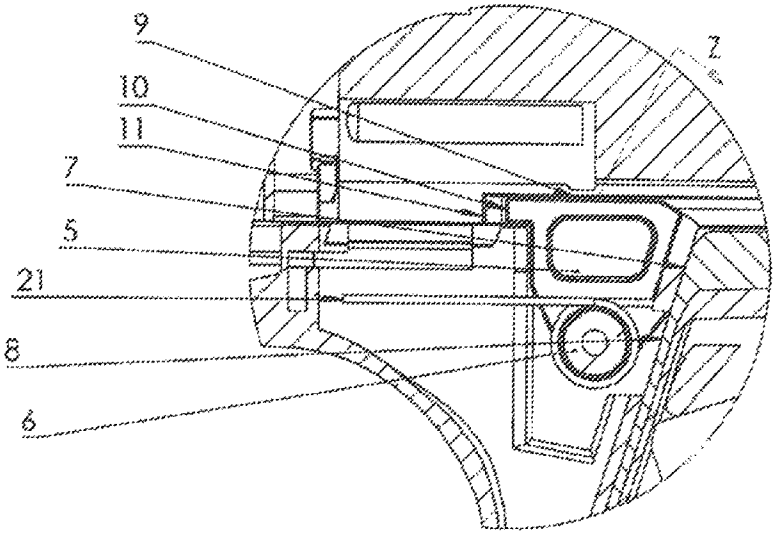
FIGS. 4 and 5 show the details IV of FIG. 1 and V of FIG. 3.
Figure 5:
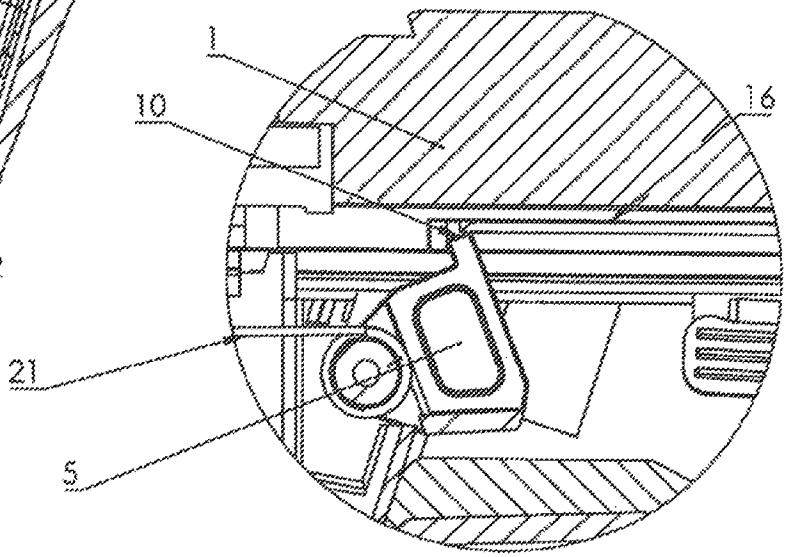

FIG. 4 shows the detail IV of FIG. 1; the disassembling lever 5 and its axis of rotation 6 in the receiver 19, and the shape of the disassembling lever 5, are clearly visible. The disassembling lever 5 has two end positions, the one shown in FIG. 4 is called working position, the other, shown in FIG. 5, is called disassembly position. It has a front edge 7, which is given this designation even though it may very well be of flat construction, and is in contact with the rear side 8 of the magazine 2. This contact prevents the magazine from any rotation about the axis of rotation 6 by the disassembling lever 5 in the direction of the arrow Z.

The disassembling lever 5 has the form and function of a cam, namely having a part being a disc or a roll which is rotatable around an axis 6 which is provided in the frame of the pistol and having a contour which deviates from circular form. By this, in dependency of the angular position in respect to the axis, its periphery in a given direction relative to the frame is nearer or farer from the axis. The shown embodiment of the disassembling lever 5 has a roll with a form being, roughly, that of a triangle, the axis 6 being near one of the corners of the triangle; this corner being the corner which is further away from the barrel 20 than the others, is called lower corner.

Due to this situation, the edge or border opposite to this corner, called the upper edge 9, runs parallel to the guide rail 4 for the slide 1. This edge has a prolongation on its rear side, facing away from the muzzle, called lug, or protrusion 10. On its front side, there is a chamfer or taper or bevelling.

A second edge of the roll or disc of the disassembling lever 5 on its front side (all this expressions having the "usual" meaning when the weapon is hold in its usual position, ready to fire, even if the disassembly is described), called front edge 7, is facing the rear side 8 of the magazine 2.

Figure 2:
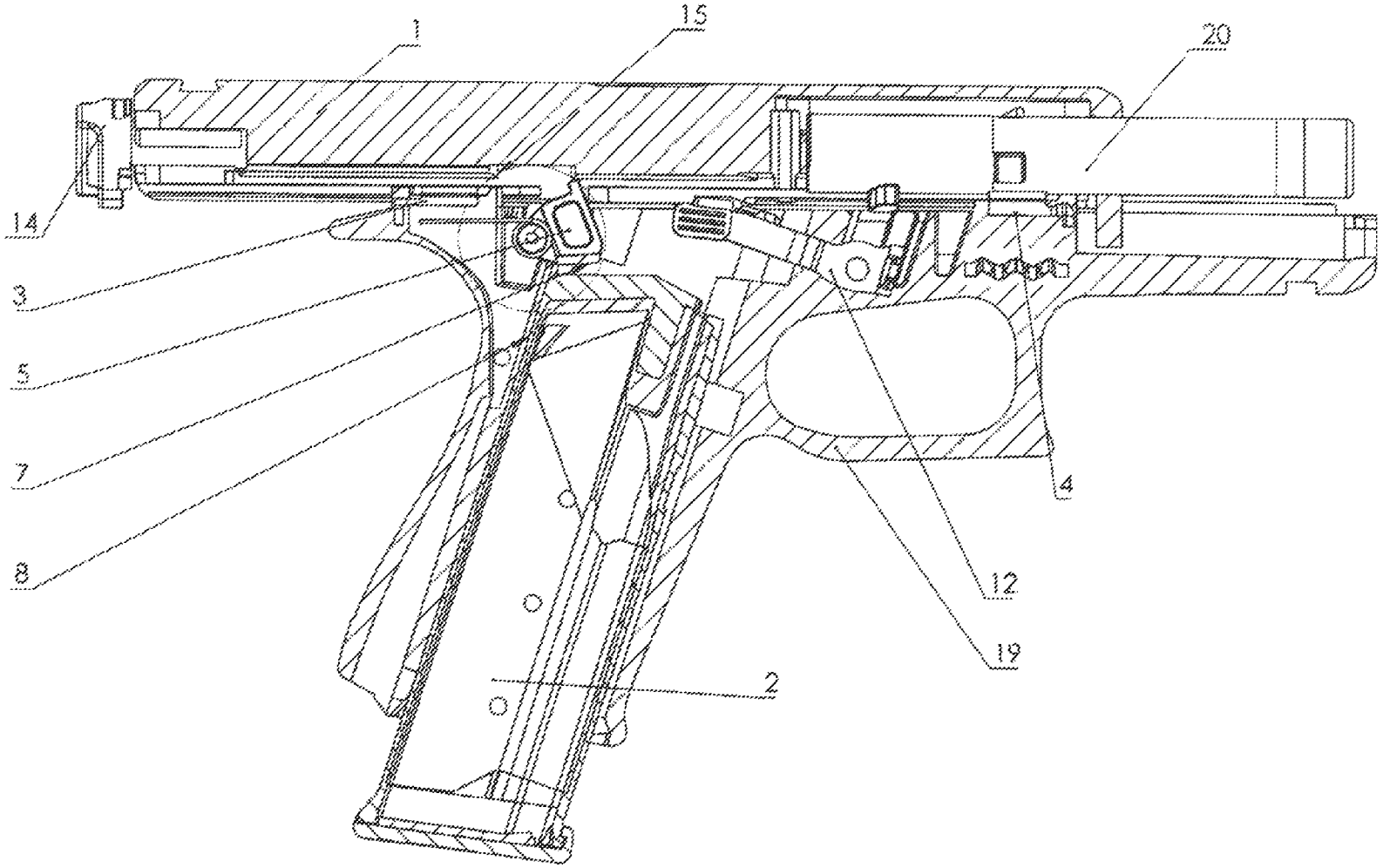
FIG. 2 shows the firearm from FIG. 1 in the condition ready for disassembly.

The disassembling lever 5 may be rotated by a user between two end positions, called firing position (FIG. 1) and disassembling position (FIG. 2). It should be stated already here that, there is a possibility to provide a spring which urges the disassembling lever 5 into its firing position; in this case, the user has to overcome the force of the spring when turning the lever into its disassembly position.

Returning to the upper edge 9 of the disassembling lever 5 in its firing position, one states that, the lower edge of the slide 1 is situated parallel to it and in a small distance, only preventing any contact between normal uses of the weapon. For this reason, the disassembling lever 5 may not be rotated, because such rotation would be blocked by direct contact between the slide and the lever.

Similarly, the front edge 7 of the disassembling lever 5 in its firing position is situated parallel to it and in a small distance from the rear side 8 of the magazine 2. This situation prevents any rotation of the disassembling lever 5 independently from the situation around the upper edge 9.

In both cases, the "small distance" is only provided in order that no interference in any way with the normal uses of the weapon may occur. Normal uses include the movements in connection with firing, especially the vibrations and the thermal expansions. This means that, a clearance of some hundredths millimetres is sufficient, but some millimetres would do as well, as long the rotation of the disassembling lever 5 is prevented by the interfering of the two surfaces in the firing position of the weapon.

Size and shape of the roll or disc of the disassembly lever 5 and position of the axis 6 in the weapon depend on the shape and size of the weapon. Knowing the weapon and the invention, it is no problem for the man skilled in the art to design a suitable construction.

Now further with the description: The disassembling lever 5 has an upper edge or surface 9 that lies at a minimal clearance from a lower edge of the slide 1 (upper slide path 16, FIG. 5) and, independently of the magazine 8, likewise prevents any rotation by the disassembling lever 5 in the direction of rotation Z. Finally, the disassembling lever 5 also has a rear edge 10 against which, during the forward movement of the slide 1 under the action of the retaining spring (not illustrated), an abutment 11, which may be seen as a breechblock stop of the slide 1, too, abuts when the firing pin mechanism is unlocked. But in the position illustrated, the firing pin mechanism is ready for firing, corresponding to the condition of the firearm ready for firing.

The region of the rear guide rail 3 and the front guide rail 4 were indicated in FIG. 1 in order to point out the connection of the slide 1 with the receiver 19.

In order to disassemble the firearm, it is necessary to put its parts into the position illustrated in FIG. 2. In a known manner, the slide stop device 12 holds the slide 1 in its rear end position in relation to the receiver 19, on the rear guide rail 3 and the front guide rail 4. The magazine 2 is lowered so that the edges or surfaces 7, 8 are disengaged, the chamber is empty. The position of the slide 1 in relation to the guide rails 3, 4 has the effect that an opening region 15 of the slide 1 has been moved into the location of the disassembling lever 5, so that the latter can be rotated in the direction of the arrow Z (FIG. 4), as shown in FIG. 2. This is indicated by the circle which gives the outermost positions of the lever 5 when it is rotated around its axis. The circle is shown in its entirety without taking into account the limits of the rotation. This rotation has the result that lever 5 no longer obstructs a forward movement of the slide 1 along the guide rails 3, 4. The firing pin mechanism 14 is still shown in its work-position.

Figure 3:
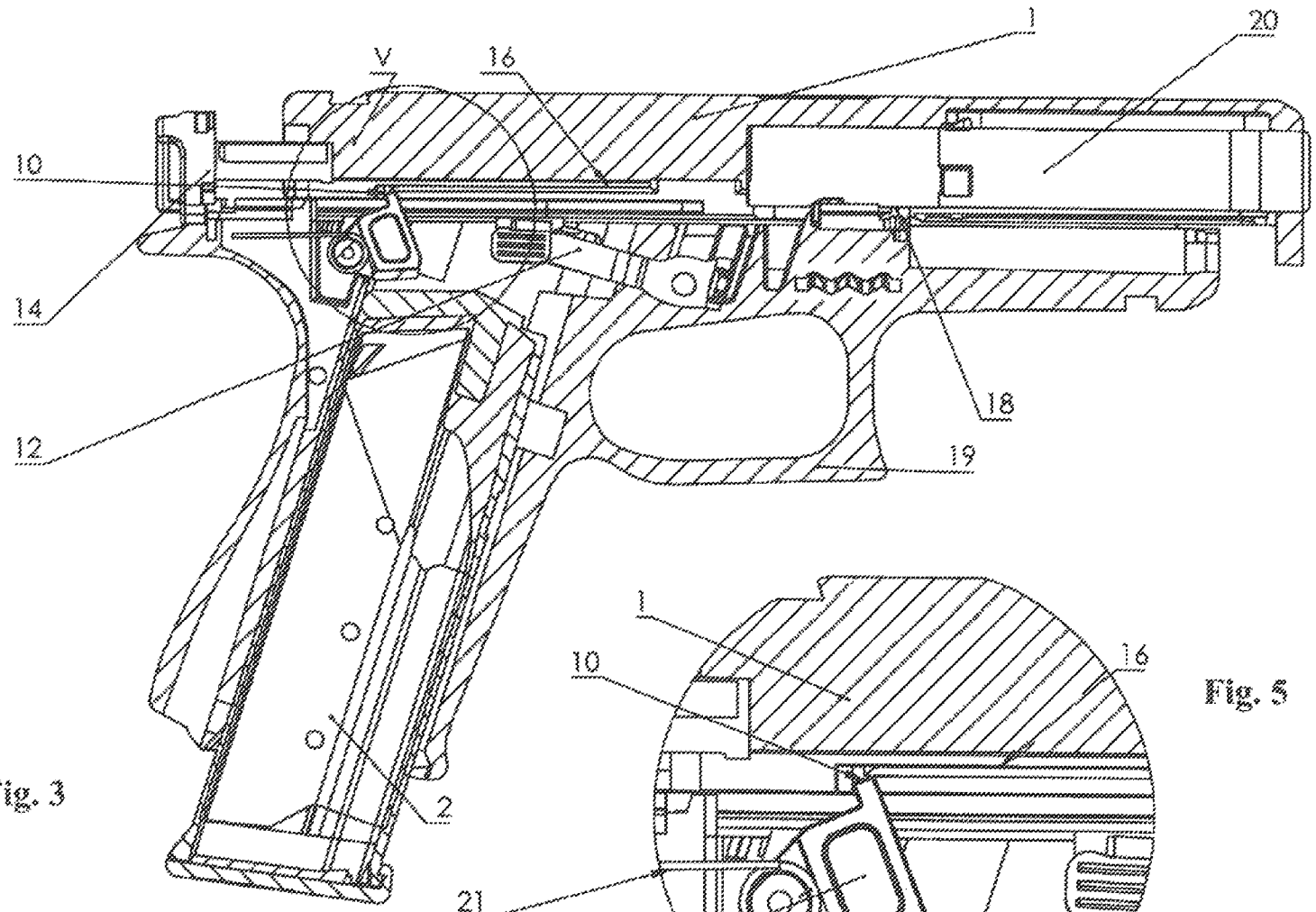
FIG. 3 shows the disassembling position of this firearm.

As can be seen from FIG. 3, in the illustrated exemplary embodiment the firing pin mechanism 14 is allowed to move in the direction parallel to the guide rails 3, 4, for example by rotating a bayonet mounting in relation to the slide 1, and may be either removed or pulled out to at least a certain extent to the rear (as shown). In both variants, that the trigger mechanism and the firing pin mechanism 14 are disengaged, and it is then possible, by releasing the slide stop device 12 as illustrated in FIG. 3, to remove the slide 1 forwards.

It depends from the choice of the described disengagement, whether it is possible, to remove the slide forwards until it comes off the guide rails. This is the case when the firing pin mechanism 14 is removed from the slide. If it is pulled out to at least a certain extent, to the rear, but still in the slide (as shown in FIG. 3), one may move the slide forwards to this certain extent. The guide rails 3, 4 have their front ends at a place which makes sure that, their counterparts on the slide are free after their travel of said certain extent. This makes it possible to remove the slide in this position upwards from the guide rails and the receiver 19.

In the illustrated exemplary embodiment, the disassembling lever 5 performs a further task here: by means of a lug 10 or a similar protrusion, it projects into the upper slide path 16 of the slide 1 such that it arrests the slide 1 at the position where it interacts with the openings in an lower slide path having the rails 3, 4. The openings are provided such that in this position they come into the regions of the front and rear guide rails 3, 4, with the result that in this position the slide can be removed upwards, perpendicular to the guide rails 3, 4. It is of course also possible to clear the firing pin device 14 entirely, such that it can be withdrawn from the slide 1, to dispense with the lug 10 of the disassembling lever 5 and then to remove the slide 1 forwards over the entire length. Which of these two possibilities is chosen is once again a question of individual preference.

In FIG. 3, the free position of the guide rail 4 and its counterpart on the slide is indicated with the numeral 18.

As shown in FIGS. 4 and 5, a spring 21 is provided, which urges the disassembling lever 5 away from its disassembly position in order to give it a defined rest position. It goes without saying that, it is not necessary to us such a spring: In the situation depicted in FIG. 2 with no intention to disassemble but simply to change the magazine, the new magazine would rotate the lever 5 counter clockwise in its working position, even without spring 21. Nevertheless, the presence of the spring 21 makes things smoother.

As is clear from the statements made, the question of which type of barrel is used is not significant in conjunction with the invention.

If the disadvantages mentioned in the introduction are accepted or avoided by other measures according to the design and basic construction of the pistol, the firing pin device may also be cleared in the same or a similar way to that provided in GB 151 196.

As mentioned above, the invention is also applicable to hammer pistols, since here too the slide is removed forwards. The extent to which, and the manner in which, part of the trigger mechanism is housed in the slide at all, and whether a separation is thus required in the course of disassembly, can be readily determined on an individual basis, based on the design and basic construction of the pistol, by those skilled in the art who have knowledge of the invention and of the firearm.

For the jurisdictions in which this is possible, the disclosures of GB 151 196 A and of:

| |
|---|
| US2017/0227313 A1, |
| US2017/0198993 A1, |
| US 2015/0211822 A1, |
| US 2015/0192378 A1, |
| US 2013/0239451 A1, |
| US 2011/0167706 A1, |
| US 2005/0115130 A1, |
| US 2004/0111945 A1, |
| US 2003/0061753 A1, |
| U.S. Pat. No. 8,528,243 B1, |
| U.S. Pat. No. 4,825,744 (A), |
| U.S. Pat. No. 4,893,546 (A) and |
| U.S. Pat. No. 4,539,889 (A) |

are incorporated into the content of the present description and application by reference.

In the description and the claims, the terms "front", "rear", "upper", "lower" and so on are used in the generally accepted form, with reference to the article in its usual position of use. That is to say that in the case of a firearm the mouth of the barrel is at the "front", the slide is moved to the "rear" by the explosion gases, etc. The designation of the direction of the barrel relates to the barrel axis, and "transversely thereto" means substantially a direction rotated by 90° thereto.

It should also be pointed out that, in the description and the claims, indications such as "lower region" of a hanger, reactor, filter, building, device, part, or quite generally an article means the lower half and in particular the lower quarter of the entire height; "bottom region" means the bottom quarter and in particular an even smaller part; while "middle region" means the middle third of the entire height (width-length). All these indications have their generally accepted meaning, applied to the intended position of the article in question.

In the description and the claims, "substantially" means a deviation of up to 10% from the stated value, if this is physically possible a deviation both above and below, otherwise only in the meaningful direction; in the case of indications of degree (angle and temperature) ±10° is thus meant.

All indications of quantity and proportion, in particular those for delimiting the invention, unless they relate to concrete examples, should be understood as having a tolerance of ±10%: thus, for example, 11% means from 9.9% to 12.1%. In the case of designations such as "a solvent", the word "a" should not be regarded as a number but as an article, unless something else is apparent from the context.

The term "combination" or "combinations" refers to all types of combinations, unless indicated otherwise, from two of the components concerned to a multiplicity of such components; the term "containing" is also used to mean "comprising".

The details, features and variants indicated in the individual embodiments and examples of the description and/or drawing may be combined with those in other examples and embodiments of the description and/or drawing as desired, and may be used in particular to characterise the invention in the claims without necessarily including other details of the respective embodiment or example List of reference numerals:

| | |
|---|---|
| 01 | Slide |
| 02 | Magazine |
| 03 | Rear guide rail |
| 04 | Front guide rail |
| 05 | Disassembling lever |
| 06 | Axis of rotation |
| 07 | Front edge |
| 08 | Magazine rear side |
| 09 | Upper surface/edge |
| 10 | Lug, protrusion |
| 11 | Abutment/Stop |
| 12 | Slide stop device/lever |
| 13 | Control block |
| 14 | Firing pin mechanism |
| 15 | Opening region |
| 16 | Upper slide path |
| 17 | Lower slide path |
| 18 | Free position of the rails |
| 19 | Receiver |
| 20 | Barrel |
| 21 | Spring of disassembling lever |
| Z | Direction of rotation |

The invention claimed is:

1. A firearm, comprising:

a slide having a barrel;

a receiver coupled to the slide, including a trigger mechanism;

at least one guide rail engaged with the slide;

a slide stop device configured to retain the coupled slide in a rearward position on the receiver;

a retaining spring; and a firing pin mechanism connected to and configured to cooperate with the trigger mechanism;

wherein the firearm further comprises a disassembling lever rotatable in the receiver about an axis of rotation extending transversely to the direction of the barrel, where the disassembling lever is rotatable between a first end position and a second end position;

wherein when the disassembling lever is in the first end position:

an abutment of the slide abuts against a rear edge of the disassembling lever as the slide moves forward under the action of the retaining spring and cannot be moved further forward;

independently of said abutment of the slide against the disassembling lever, a rear side of a magazine fully inserted into the receiver is in contact with a front edge of the disassembling lever and prevents any rotation by the disassembling lever;

independently of said contact of the magazine with the disassembling lever, an upper edge or surface of the disassembling lever is parallel with and adjacent to a lower edge of the slide such that contact between the slide and the disassembling lever prevents any rotation by the disassembling lever; and when the magazine is completely or partially withdrawn from the receiver and the slide is stopped by the slide stop device, the disassembling lever can be rotated into said second end position, with the result that once the trigger mechanism has been disengaged from the firing pin mechanism and the slide stop device has been cleared, the slide can be removed from the receiver either forwardly or forwardly and upwardly.

2. The firearm of claim 1, wherein the lower edge of the slide defines an upper slide path of the slide.

3. The firearm of claim 1, further comprising a spring configured to urge the disassembling lever away from said second end position.

4. The firearm of claim 1, wherein the firearm is a pistol.

* * * * *